US010273702B1

(12) United States Patent
Cunerty

(10) Patent No.: US 10,273,702 B1
(45) Date of Patent: Apr. 30, 2019

(54) LIFT ASSEMBLY FOR A SPA COVER

(71) Applicant: John Joseph Cunerty, Toronto (CA)

(72) Inventor: John Joseph Cunerty, Toronto (CA)

(73) Assignee: John Joseph Cunerty, Toronto (CA)

( * ) Notice: Subject to any disclaimer, the term of this patent is extended or adjusted under 35 U.S.C. 154(b) by 0 days.

(21) Appl. No.: 16/173,752

(22) Filed: Oct. 29, 2018

Related U.S. Application Data

(60) Provisional application No. 62/751,195, filed on Oct. 26, 2018.

(51) Int. Cl.
*E04H 4/08* (2006.01)

(52) U.S. Cl.
CPC ..... *E04H 4/084* (2013.01)

(58) Field of Classification Search
CPC ..... E04H 4/084
USPC ..... 4/498
See application file for complete search history.

(56) References Cited

U.S. PATENT DOCUMENTS

| | | | |
|---|---|---|---|
| 4,163,295 | A | 8/1979 | Schutz |
| 4,853,985 | A | 8/1989 | Perry |
| 5,339,494 | A | 8/1994 | Esau et al. |
| 5,974,600 | A | 11/1999 | Pucci et al. |
| 6,000,071 | A | 12/1999 | Fettes |
| 6,000,072 | A | 12/1999 | LaHay |
| 6,032,305 | A | 3/2000 | Tedrick |
| 6,442,799 | B1 | 9/2002 | Duarte et al. |
| 6,601,834 | B2 | 8/2003 | Perry |
| 6,718,566 | B1 | 4/2004 | Wilson |
| 6,795,984 | B1 | 9/2004 | Brady |
| 6,938,281 | B1 | 9/2005 | Tudor |
| 7,784,120 | B2 | 8/2010 | Spicer |
| 8,516,626 | B2 | 8/2013 | Gardenier et al. |
| 9,181,721 | B2 | 11/2015 | Spicer |
| 2002/0050003 | A1 | 5/2002 | Perry |
| 2003/0150054 | A1 | 8/2003 | Tudor |

(Continued)

FOREIGN PATENT DOCUMENTS

| | | | |
|---|---|---|---|
| CA | 2421332 | A1 | 9/2003 |
| CA | 2537640 | A1 | 8/2007 |
| CN | 203487817 | U | 3/2014 |

OTHER PUBLICATIONS

Ultralift HM Cover Lifter Hydraulic Mount, Parts List, Byron Originals, Oct. 1, 2012.

(Continued)

*Primary Examiner* — Christine J Skubinna
(74) *Attorney, Agent, or Firm* — Bereskin & Parr LLP/ S.E.N.C.R.L., s.r.l.

(57) ABSTRACT

A lift assembly includes a lever arm mounting portion connected to a spring mounting portion, a lever arm, a spa cover engaging portion, and a pneumatic spring. A pneumatic spring proximal end portion has a pivoting connection to the spring mounting portion. A pneumatic spring distal end portion has a pivoting connection to the lever arm. The pneumatic spring exerts an extensive force upon the lever arm both when the lever arm is in the cover closed position and when the lever arm is in the cover open position. The extensive force urges the lever arm towards the cover open position when the lever arm is in the cover closed position, and the extensive force urging the lever arm towards the cover closed position when the lever arm is in the cover open position.

16 Claims, 5 Drawing Sheets

(56) References Cited

U.S. PATENT DOCUMENTS

| | | | | |
|---|---|---|---|---|
| 2004/0055081 | A1 | 3/2004 | Wilson | |
| 2004/0143895 | A1 | 7/2004 | Loyd et al. | |
| 2007/0017016 | A1 | 1/2007 | Piche et al. | |
| 2007/0022524 | A1* | 2/2007 | Duarte | E04H 4/084 4/498 |
| 2007/0107118 | A1 | 5/2007 | Tudor | |
| 2007/0209104 | A1 | 9/2007 | Buzzetti et al. | |
| 2008/0244820 | A1 | 10/2008 | Moore | |
| 2009/0126097 | A1 | 5/2009 | Kanetis | |
| 2010/0186159 | A1 | 7/2010 | Dalickas | |
| 2011/0048654 | A1 | 3/2011 | Kolar | |
| 2013/0117922 | A1 | 5/2013 | Spicer | |
| 2014/0123380 | A1 | 5/2014 | Cunerty | |
| 2015/0184411 | A1 | 7/2015 | Mller | |
| 2016/0053505 | A1 | 2/2016 | Dose | |
| 2016/0123027 | A1* | 5/2016 | Cunerty | E04H 4/084 4/498 |

OTHER PUBLICATIONS

PCT Search Report, PCT/CA2015/051126, dated Feb. 5, 2016.
Canadian Office Action dated May 24, 2017 Issued in corresponding Canadian Application No. 2,965,723.
Canadian Office Action dated Oct. 5, 2018 issued in corresponding Canadian Application No. 2,965,723.
Supplementary European Search dated Jun. 29, 2018 for corresponding EP Application 15857299.

* cited by examiner

LIFT ASSEMBLY FOR A SPA COVER

FIELD

This application relates to the field of lift assemblies for assisting the lifting of spa covers between a cover closed position and a cover open position.

INTRODUCTION

A spa, also referred to as a whirlpool or hot tub, is a large vessel for holding a volume of liquid (e.g. water or mud) and one or more user occupants. Typically, a user occupant sits or lies down in the spa while at least partially submerged in the liquid. This may provide a user occupant with, for example relaxation or therapy.

A spa may contain hundreds or even thousands of liters of liquid. Often, the liquid in the spa is heated to a temperature well above ambient, which may require considerable energy consumption. Accordingly, some spas may include an insulated cover, at least in part for preventing the escape of heat from the liquid when the spa is not in use.

DRAWINGS

SUMMARY

Figure 1:
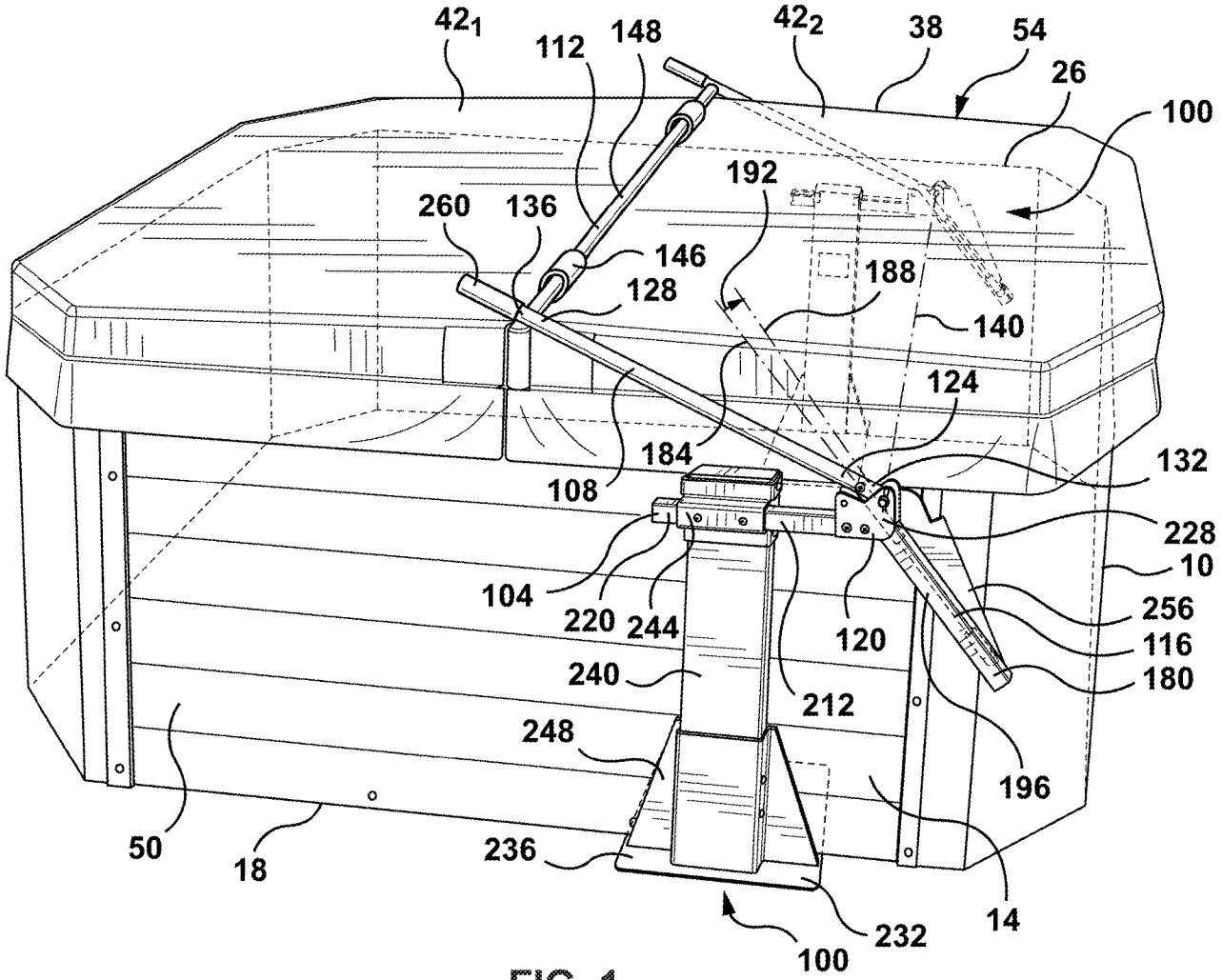
FIG. 1 is a perspective view of a spa equipped with a spa cover and two lift assemblies, in which the spa cover is in the spa cover closed position, in accordance with an embodiment.

In one aspect, a lift assembly is provided for assisting lifting a spa cover between a cover closed position, in which the spa cover closes an upper end of a spa, and a cover open position. The lift assembly may include a spa mounting assembly, a lever, a spa cover engaging member, and a pneumatic spring. The spa mounting assembly may in use be rigidly connectable to a spa. The spa mounting assembly may have a lever arm mounting portion connected to a spring mounting portion. The lever arm may extend longitudinally from a lever arm proximal end portion to a lever arm distal end portion. The lever arm proximal end portion may have a pivoting connection to the lever arm mounting portion. The pivoting connection may have a lever arm rotation axis. The lever arm rotation axis may extend in a rearward direction. The lever arm may be rotatable relative to the spa mounting assembly about the lever arm rotation axis between (i) a cover closed position in which the lever arm distal end portion is laterally inwardly of the lever arm rotation axis, and (ii) a cover open position in which the lever arm distal end portion is laterally outwardly of the lever arm rotation axis. The spa cover engaging member may be connected to the lever arm distal end portion. The pneumatic spring may include a pneumatic cylinder and a piston rod. The pneumatic spring may extend longitudinally from a pneumatic spring proximal end portion to a pneumatic spring distal end portion. The pneumatic spring proximal end portion may have a pivoting connection to the spring mounting portion at a location that is laterally outwardly of the lever arm rotation axis and that is at an elevation below the lever arm rotation axis. The pneumatic spring distal end portion may have a pivoting connection to the lever arm at a location between the lever arm rotation axis and the lever arm distal end portion. The pneumatic spring may exert an extensive force upon the lever arm both when the lever arm is in the cover closed position and when the lever arm is in the cover open position. The extensive force may urge the lever arm towards the cover open position when the lever arm is in the cover closed position, and the extensive force may urge the lever arm towards the cover closed position when the lever arm is in the cover open position.

In another aspect, a lift assembly is provided for assisting lifting a spa cover between a cover closed position and a cover open position. The lift assembly may include a lever arm mounting portion, a spring mounting portion, a lever arm, a spa cover engaging member, and a pneumatic spring. The lever arm mounting portion may be connected to the spring mounting portion. The lever arm may extend from a lever arm proximal end portion to a lever arm distal end portion. The lever arm proximal end portion may have a pivoting connection to the lever arm mounting portion. The pivoting connection may have a lever arm rotation axis. The lever arm may be rotatable relative to the lever arm mounting portion and the spring mounting portion about the lever arm rotation axis between (i) a cover closed position, and (ii) a cover open position. The spa cover engaging member may be connected to the lever arm distal end portion. The pneumatic spring may include a pneumatic cylinder and a piston rod. The pneumatic spring may extend from a pneumatic spring proximal end portion to a pneumatic spring distal end portion. The pneumatic spring proximal end portion may have a pivoting connection to the spring mounting portion. The pneumatic spring distal end portion may have a pivoting connection to the lever arm. The pneumatic spring may exert an extensive force upon the lever arm both when the lever arm is in the cover closed position and when the lever arm is in the cover open position. The extensive force may urge the lever arm towards the cover open position when the lever arm is in the cover closed position, and the extensive force may urge the lever arm towards the cover closed position when the lever arm is in the cover open position.

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", "joined", "affixed", or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Some elements herein may be identified by a part number, which is composed of a base number followed by an alphabetical or subscript-numerical suffix (e.g. 112*a*, or $\mathbf{112}_1$). Multiple elements herein may be identified by part numbers that share a base number in common and that differ by their suffixes (e.g. $\mathbf{112}_1$, $\mathbf{112}_2$, and $\mathbf{112}_3$). All elements with a common base number may be referred to collectively or generically using the base number without a suffix (e.g. 112).

Figure 2:
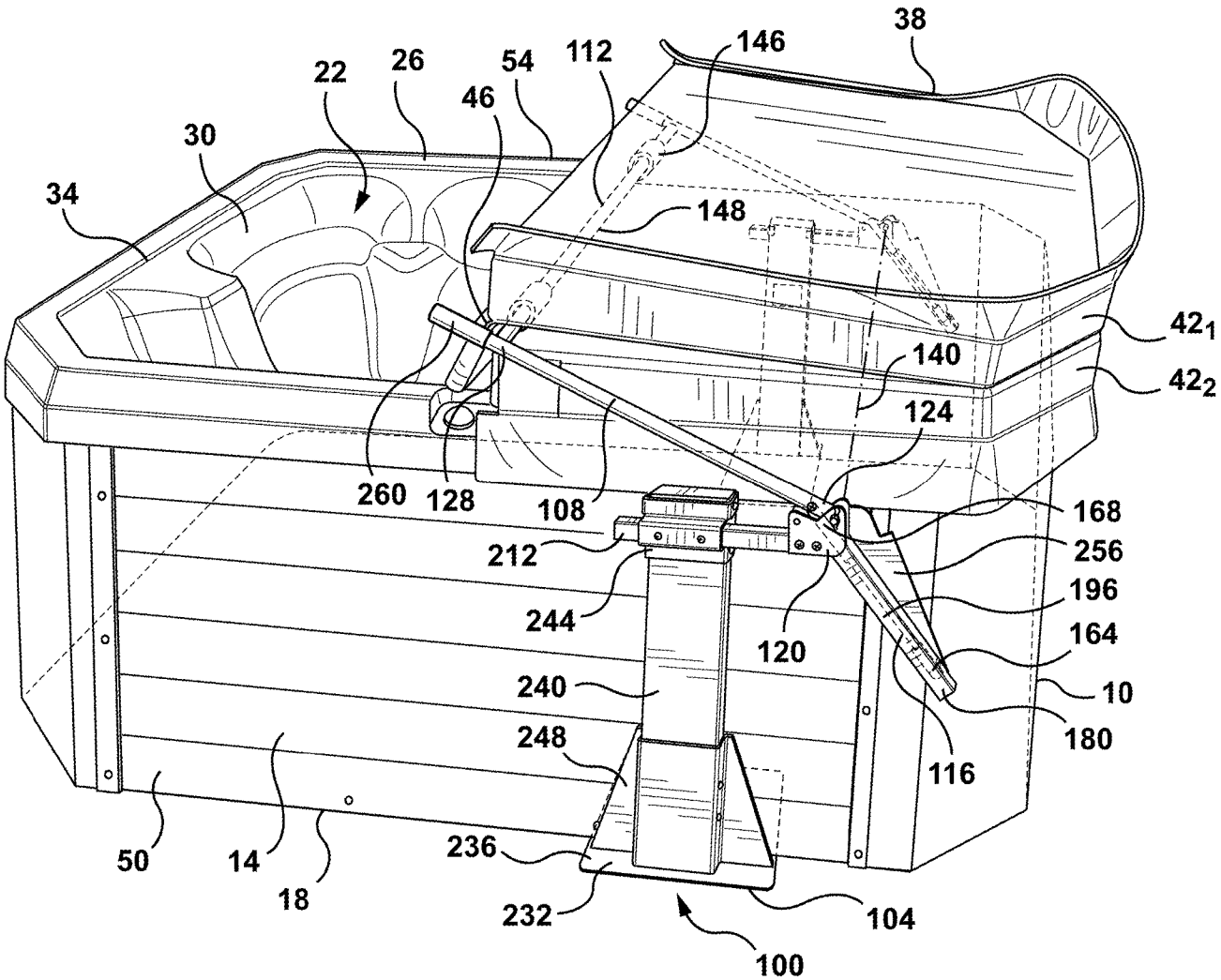
FIG. 2 is a perspective view of the spa of FIG. 1 with the spa cover folded over a spa cover engaging portion of the lift assemblies, in accordance with an embodiment.
Figure 3:
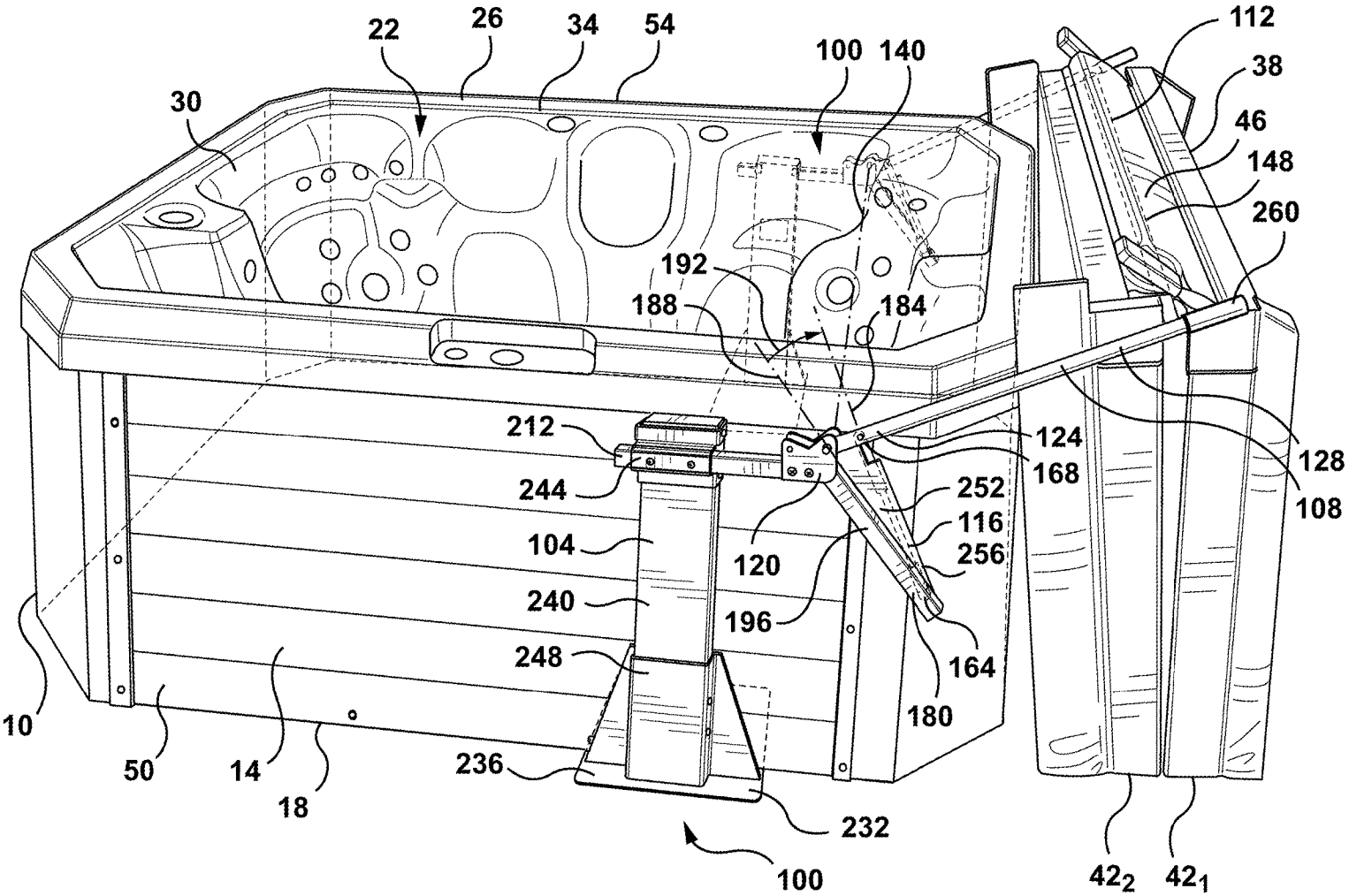
FIG. 3 is a perspective view of the spa of FIG. 1, with the spa cover and lift assembly in a spa cover open position, in accordance with an embodiment.
Figure 4:
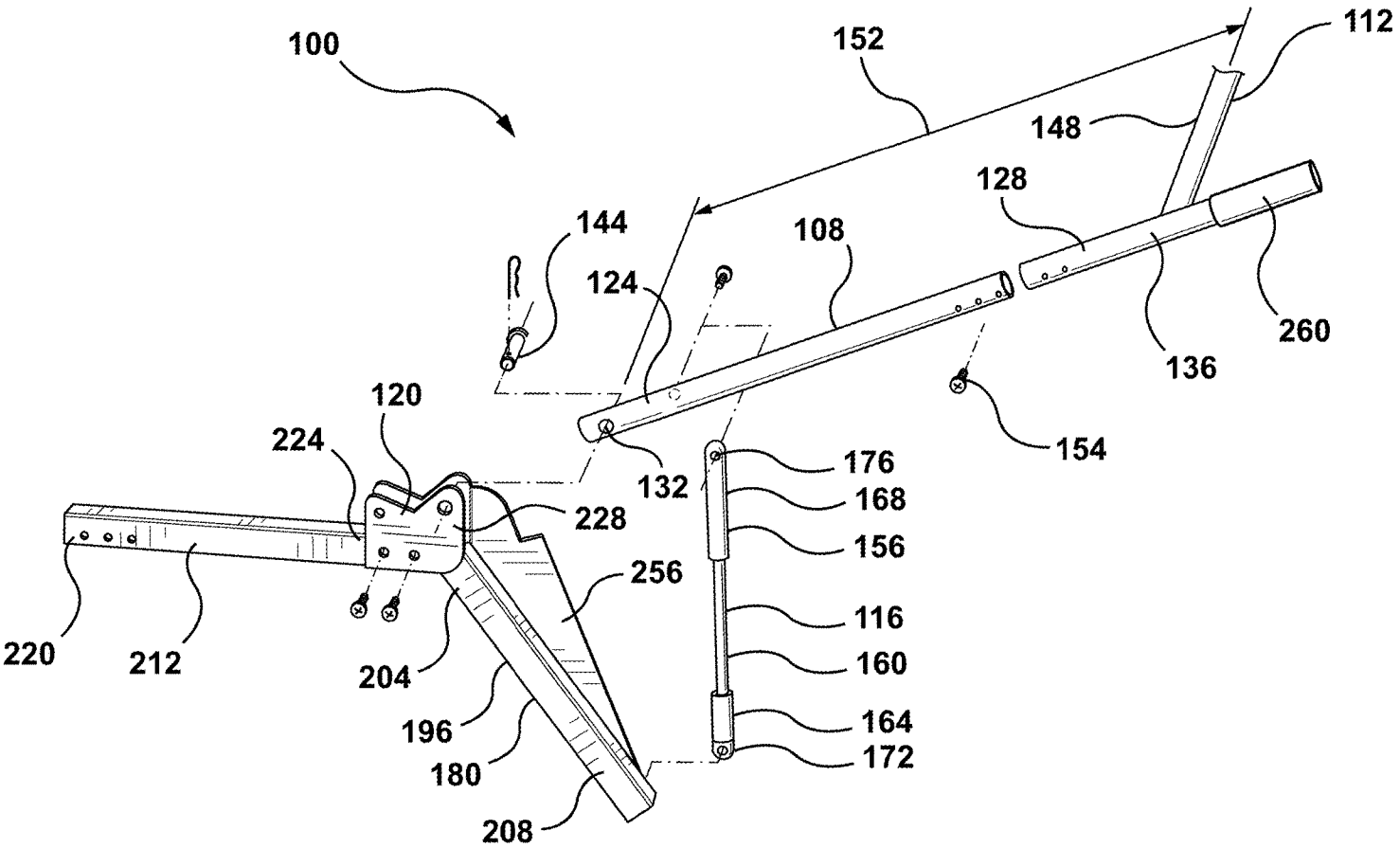
FIG. 4 is an exploded view of the lift assembly of FIG. 1.

FIGS. 1-3 show a spa 10 (also referred to as a hot tub or a whirlpool). As shown, spa 10 includes sidewalls 14 and a bottom 18, which collectively define an interior chamber 22 for containing a volume of water and one or more user occupants. Spa 10 includes an upper end 26 that defines an upper opening 34 for user entry into and exit from interior chamber 22.

Sidewalls 14 and bottom 18 may be configured to provide an chamber 22 suitable for user occupants. In the illustrated example, sidewalls 14 and bottom 18 define a substantially rectangular footprint with chamfered corners. In other embodiments, sidewalls 14 and bottom 18 may define a circular, triangular or other regular or irrelegularly shaped footprint.

In the illustrated example, interior chamber 22 may include an inner tub 30 positioned above bottom 18 between sidewalls 14. As shown, inner tub 30 may be contoured to provide seating for user occupants of spa 10, as is known in the art. Further, spa 10 may include one or more jets positioned to direct air and/or water into spa interior chamber 22 below the water level inside the spa 10. It will be appreciated that in some embodiments, tub 30 may be integrally formed with one or more (or all) of sidewalls 14 and bottom 18.

As shown, a spa cover 38 is positionable over the spa upper end 26 to close at least a portion of (or all of) spa upper opening 34. In the illustrated example, spa cover 38 is shown having a size and shape that covers an entirety of spa upper end 26. In some embodiments shown, spa cover 38 may be foldable. For example, spa cover 38 may include two or more portions 42 joined at a seam 46, and foldable over the seam 46. In the illustrated example, spa cover 38 includes two spa cover portions 42 of substantially equal size and shape. As seen in the transition from FIG. 1 to FIG. 2, spa cover portion $\mathbf{42}_1$ can be folded about seam 46 over spa cover portion $\mathbf{42}_2$. When folded, the spa cover may have a more compact configuration that is easier to store.

In alternative embodiments, one or more (or all of) cover portions 42 may be differently sized and/or shaped to cover differently sized and/or shaped portions of spa upper end 26. In some embodiments, spa 10 may include two discrete covers 38, which are not connected by a seam. In some embodiments, spa 10 may include a spa cover 38 having only one spa cover portion 42, which is not foldable.

Cover 38 may be movable between a spa cover closed position (shown by example in FIG. 1), in which cover 38 rests on spa upper end 26 (overlying spa upper opening 34), and a spa cover open position (shown by example in FIG. 3). In the spa cover open position, cover 38 may be clear of spa upper opening 34. For example, cover 38 may be located laterally outwardly of spa 10 as shown. For example, cover 38 may be moved to the spa cover open position to provide user access to spa interior chamber 22 through spa upper opening 34, and moved to the spa cover closed position after all users have exited the spa interior chamber 22. As shown by example in FIGS. 1-3, where spa cover 38 is foldable, spa cover 38 may be folded before moving spa cover 38 to the spa cover open position, and spa cover 38 may be unfolded in the spa cover closed position.

In the closed position, spa cover 38 may seal interior chamber 22, and the water contained therein, from the external environment to mitigate entry of dirt/debris and loss of heat. A spa may be sized to hold hundreds or even a thousand liters of water (or other liquid, e.g. mud). Further, the water inside may be heated to temperatures of up to 40° C. or higher. The energy consumption required to heat such volumes of water is significant. Therefore, a spa cover may be configured to provide insulation against heat loss. In this way, the spa cover may reduce the time required to heat the water inside interior chamber 22, and may conserve the water temperature for future usage. In the illustrated example, cover 38 may be from several inches to a foot or more thick (e.g. 4-20 inches) to provide the desired insulating properties. Further, cover 38 may weigh from tens of pounds to a hundred pounds or more (e.g. 20-150 lbs). This may make moving the cover 38 between the spa cover closed and open positions difficult for a user, if not assisted.

Referring to FIGS. 1-4, cover 38 is connected to at least one lift assembly 100. A lift assembly 100 is user operable for selectively removing and replacing cover 38 over spa upper opening 34. A lift assembly 100 reduces the force required from a user to move cover 38 from the spa cover open position to the spa cover closed position, and also from the spa cover closed position to the spa cover open position. For example, a lift assembly 100 may supplement user-applied force to cover 38 to reduce the effective weight of the cover 38 for a user moving the cover 38 between the spa cover open and closed positions.

In the illustrated example, two lift assemblies 100 are connected to spa 10. As shown, one lift assembly 100 may be connected to spa front end 50, and one lift assembly 100 may be connected to spa rear end 54. Both lift assemblies 100 may act upon the same spa cover 38. This may provide balance in the application of force by lift assemblies 100 to spa cover 38, which may mitigate the spa cover 38 twisting.

In alternative embodiments, only one lift assembly 100 may be connected to spa 10 and cover 38. For example, the lift assembly 100 may be solely responsible for supplementing user applied force to move spa cover 38, while a simple linkage is provided on an opposite end of spa 10 to mitigate the spa cover 38 twisting.

Still referring to FIGS. 1-4, lift assembly 100 may include a spa mounting assembly 104, a lever arm 108, a spa cover engaging member 112, and a pneumatic spring 116. As shown, spa mounting assembly 104 may mount lift assembly 100 at a fixed location with respect to spa 10. Lever arm 108 is connected to spa cover engaging member 112. When spa cover engaging member 112 is engaged with spa cover 38 (e.g. by spa cover straps 146 and/or by folding spa cover 38 over spa cover engaging member 112 (FIG. 2)), a user may rotate lever arm 108 to carry spa cover 38 between the spa cover closed position (FIG. 1) and the spa cover open position (FIG. 2).

Pneumatic spring 116 is connected to lever arm 108, and reduces the force required by the user to carry spa covers 38 (i) between the spa cover closed position (FIG. 1) and the spa cover open position (FIG. 3), and (ii) between the spa cover open position (FIG. 3) and the spa cover closed position (FIG. 1). This allows lift assembly 100 to make it possible (or much easier) for a user to move a heavy spa cover 38 between the spa cover closed and open positions.

Spa mounting assembly 104 includes a lever arm mounting portion 120. Lever arm 108 extends longitudinally from a proximal end portion 124 to a lever arm distal end portion 128. Proximal end portion 124 may include lever arm proximal end 132. Distal end portion 128 may include lever arm distal end 136. As shown, lever arm proximal end portion 124 may have a pivoting (e.g. rotating) connection to lever arm mounting portion 120. For example, lever arm proximal end portion 124 may be connected to lever arm mounting portion 120, and rotatable about a lever arm rotation axis 140 between the spa cover closed position (FIG. 1), and the spa cover open position (FIG. 3).

The pivoting connection of lever arm 108 to spa mounting assembly 104 may be provided in any manner that allows lever arm 108 to rotate relative to spa mounting assembly 104 between the spa cover closed and open positions. For example, the pivoting connection may be provided by a hinge 144 that rotatably connects lever arm proximal end portion 124 to lever arm mounting portion 120.

Still referring to FIGS. 1-4, spa cover engaging member 112 may be connected to lever arm distal end portion 128 in any manner that allows spa cover engaging member 112 to move with lever arm 108, as the user rotates lever arm 108 between the spa cover closed and open positions. This allows the user to rotate lever arm 108 in order to cause spa cover engaging member 112 to carry spa cover 38 (FIG. 3) between the spa cover closed and open positions.

In some embodiments, spa cover engaging member 112 may be rigidly connected (e.g. integrally formed with, or welded to) lever arm distal end portion 128. In other embodiments, spa cover engaging member 112 may be connected to lever arm distal end portion 128 in a manner that allows spa cover engaging member 112 to rotate about a longitudinal axis of spa cover engaging member 112. This may mitigate or eliminate frictional wear that can occur when spa cover engaging member 112 rotates relative to spa cover 38 (FIG. 3) when moving between the spa cover open and closed positions.

Referring to FIGS. 1-4, spa cover engaging member 112 may have any configuration that allows spa cover engaging member 112 to carry spa cover 38 between the spa cover closed and open positions. As shown, spa cover engaging member 112 may extend rearwardly from lever arm distal end portion 128 into engagement with spa cover 38. Engagement between spa cover engaging member 112 may be provided, for example by spa cover engaging member 112 penetrating spa cover 38, by spa cover fasteners 146 (e.g. straps as shown) which join spa cover engaging member 112 to spa cover 38, and/or by folding spa cover 38 over spa cover engaging member 112 as shown.

As exemplified, spa cover engaging member 112 may include a spa cover supporting arm 148, which extends rearwardly from lever arm distal end portion 128. Spa cover supporting arm 148 may extend over or through spa cover 38. In the illustrated example, spa cover supporting arm 148 extends over spa cover 38, and spa cover 38 is foldable over spa cover supporting arm 148. As shown, this allows spa cover supporting arm 148 to suspend spa cover 38 by spa cover seam 46, which is located between spa cover portions 42. For example, to move spa cover 38 to the spa cover open position (FIG. 3), spa cover portion $\mathbf{42}_1$ may be folded over spa cover supporting arm 148 and spa cover portion $\mathbf{42}_2$ (as seen in FIG. 2), and then lever arm 108 may be rotated so that spa cover supporting arm 148 carries spa cover 38 laterally to the spa cover open position. One spa cover engaging member 112 may be common to two lift assemblies 100, or each lift assembly may include a spa cover engaging member 112 that extends part way across spa cover 38. For example, the two spa cover engaging members 112 may join in a telescoping manner to accommodate spa covers 38 of different widths.

Lever arm distal end portion 128 may be movably connected to lever arm proximal end portion 124. For example, lever arm distal end portion 128 may be movable relative to lever arm proximal end portion 124 to increase or decrease a longitudinal distance 152 between spa cover engaging member 112 and lever arm rotation axis 140. This can allow lever arm 108 to accommodate spa covers of different dimensions.

As shown, lever arm distal end portion 128 may be movable relative to lever arm proximal end portion 124 between two or more longitudinal positions, and selectively rigidly connectable to lever arm proximal end portion 124 at each longitudinal position. For example, lever arm distal end portion 128 may have a telescoping connection with lever arm proximal end portion 124, and a set screw 154 may be inserted to fix the position of lever arm distal end portion 128 relative to lever arm proximal end portion 124.

In alternative embodiments, lever arm distal end portion 128 is not movably connected to lever arm proximal end portion 124. For example, lever arm distal end portion 128 may be rigidly connected to lever arm proximal end portion 124, such as by integral forming, welds, or fasteners.

Still referring to FIGS. 1-4, pneumatic spring 116 includes a pneumatic cylinder 156 and a piston rod 160. Pneumatic spring 116 may be single acting, and configured to exert extensive force. That is, gas pressure within pneumatic cylinder 156 may urge piston rod 160 outwardly, whereby pneumatic spring 116 is biased to extension. Pneumatic spring 116 extends longitudinally from a pneumatic spring proximal end portion 164 to a pneumatic spring distal end portion 168. Pneumatic spring proximal end portion 164 may include pneumatic spring proximal end 172. Pneumatic spring distal end portion 168 may include pneumatic spring distal end 176.

Pneumatic spring distal end portion 168 may have a pivoting connection to lever arm 108, and pneumatic spring proximal end portion 164 may have a pivoting connection to spa mounting assembly 104. As shown, pneumatic spring proximal end portion 164 may have a pivoting connection to a spring mounting portion 180 of spa mounting assembly 104. Importantly, spring mounting portion 180 is connected to lever arm mounting portion 120. This represents a major improvement over prior lift assemblies, in which an end of the pneumatic spring is connected to the spa by a separate mounting bracket, as explained below.

The angular orientation of pneumatic spring 116 in the cover closed and open positions is critical to the capacity of pneumatic spring 116 to assist with moving pneumatic spring 116 (i) from the spa cover closed position to the spa cover open position, and (ii) from the spa cover open position to the spa cover open position. As shown, an imaginary spring line 184 extends from the pivoting connection of pneumatic spring proximal end portion 164 to the pivoting connection of pneumatic spring distal end portion 168, and an imaginary pivot line 188 extends from the pivoting connection of pneumatic spring proximal end portion 164 to lever arm rotation axis 140. There is an acute angle 192 between lines 184, 188. When acute angle 192 is negative, as it is in the cover closed position (FIG. 1), the extensive force of pneumatic spring 116 urges lever arm 108 to rotate towards the cover open position (FIG. 3). When acute angle 192 is positive, as it is in the cover opened position (FIG. 3), the extensive force of pneumatic spring 116 urges lever arm 108 to rotate towards the cover closed position (FIG. 1). References to a "positive" and "negative" angle 192 in the previous statements may be reversed depending on the direction of rotation between the spa cover closed and open positions.

Pneumatic spring proximal end portion 164 must be carefully positioned in order to provide the angular relationships that allow pneumatic spring 116 to assist with both closing and opening spa cover 38. In prior lifting assemblies, in which pneumatic spring proximal end portion 164 is mounted to the spa by a separate wall mounting bracket, this presents three shortcomings.

First, it becomes the responsibility of the user to determine the mounting position for the pneumatic spring proximal end portion 164, which may be time consuming and require trial and error with some spa configurations. Thus, many users consider it necessary to pay an installer to mount their lifting assembly, which adds considerably to the overall cost of the lifting assembly. Also, it may be time consuming even for a professional installer to determine the best mounting position, which makes installers less likely to recommend the lift assembly to customers.

Second, at the ideal mounting position for the pneumatic spring proximal end portion 164, the spa sidewall may not have the required structural integrity. In use, the supplemental force supplied by the pneumatic spring is transferred to the pneumatic spring proximal end portion 164. Whereas spas used to have solid wood sidewalls that could readily support such loading, modern spas have sidewalls composed of thin plastic panels which overlay sparsely located internal framing. The required mounting position for the pneumatic spring proximal end portion 164 is unlikely to align with the internal framing of the spa sidewall, in which case the lift assembly cannot be installed (or the spa sidewall will require costly modifications).

Third, at the ideal mounting position for the pneumatic spring proximal end portion 164, there may not be a spa sidewall. Modern spas come in many shapes and sizes. For example, FIGS. 1-3 show a spa 10 having a rectangular shape with chamfered corners. In this example, the preferred mounting location for the pneumatic spring proximal end portion 164 is where the corner of the spa is chamfered and there is therefore no sidewall to mount a discrete wall mounting bracket. Thus, spa 10 is an example of a spa that is incompatible with some prior lift assemblies for this reason.

Lift assembly 100 includes a spa mounting assembly 104 that supports pivoting connections to both lever arm 108 and pneumatic spring 116. As shown, spa mounting assembly 104 includes a lever arm mounting portion 120 that is connected (e.g. rigidly connected) to a spring mounting portion 180. This avoids the need for a separate wall mount at the location of pneumatic spring proximal end portion 164, and therefore mitigates the problems enumerated above. As shown, the angular configuration of pneumatic spring 116 may be predetermined for the user, so that lift assembly 100 provides assistance in both the spa cover closed and open positions.

As shown, the pivoting connection of pneumatic spring proximal end portion 164 may be located at an elevation below lever arm rotation axis 140. This allows most of pneumatic spring 116 to remain below lever arm rotation axis 140 in both the spa cover closed position and the spa cover open position. Preferably, lever arm rotation axis 140 is located below spa upper end 26. In this case, pneumatic spring 116 may provide little or no interference with users' entry into and exit from spa interior chamber 22.

As shown, the pivoting connection of pneumatic spring proximal end portion 164 may be located laterally outwardly of lever arm rotation axis 140. This may position the pivoting connection of pneumatic spring proximal end portion 164 relatively closer to the pivoting connection of pneumatic spring distal end portion 168 in the spa cover closed position (FIG. 3, when lever arm 108 is oriented so that it extends laterally outwardly of lever arm rotation axis 140), than the spa cover open position (FIG. 1, when lever arm 108 is oriented so that it extends laterally inwardly of lever arm rotation axis 140). Accordingly, this design may allow pneumatic spring 116 to have a shorter length, and therefore exert greater extensive force, when in the spa cover closed position (FIG. 3) as compared to when in the spa cover open position (FIG. 1). This allows pneumatic spring 116 to provide greater assistance in the spa cover closed position (FIG. 3), which may be desirable, particularly where the spa cover 38 is at a lower elevation in the spa cover closed position as compared to the spa cover open position, and therefore must be lifted to the spa cover open position.

As shown, in the spa cover closed position (FIG. 1), lever arm distal end portion 128 may be positioned laterally inwardly of lever arm rotation axis 140. In the spa cover open position (FIG. 3), lever arm distal end portion 128 may be laterally outwardly of lever arm rotation axis 140. In addition, spa cover 38 may be laterally outwardly of lever arm rotation axis 140 when in the spa cover open position (FIG. 3). As shown, a center of mass of spa cover 38 may be located at a lower elevation in the spa cover open position (FIG. 3) than in the spa cover closed position (FIG. 1). The lowered position mitigates spa cover 38 obstructing light and occupants' visibility when in the spa cover open position.

Still referring to FIGS. 1-4, the pivoting connection of pneumatic spring distal end portion 168 may be located between lever arm rotation axis 140 and lever arm distal end portion 128. This allows lift assembly 100 to have a compact configuration as compared with extending lever arm 108 from lever arm rotation axis 140 away from lever arm distal end portion 128, and providing the pivoting connection on this lever arm extension. The location of the pivoting connection operates synergistically with (i) the positioning of pneumatic spring proximal end portion 164 below lever arm rotation axis 140, and (ii) a pneumatic spring 116 configured to provide extensive force. In combination, these elements allow lift assembly 100 to be compact and to create little or no interference with user's entry into or exit from the spa 10.

Spa mounting assembly 104 may have a spring mounting portion 180 with any configuration that is connected to (e.g. rigidly connected to) lever arm mounting portion 120. That is spring mounting portion 180 is connected to lever arm mounting portion 120 even when not installed on a spa. In the illustrated example, spring mounting portion 180 includes a spring mounting arm 196 that extends away from lever arm mounting portion 120. As shown, spring mounting arm 196 extends longitudinally from a spring mounting arm proximal end portion 204 connected to (e.g. rigidly connected to) lever arm mounting portion 120, to a spring mounting arm distal end portion 208. The pivoting connection of pneumatic spring proximal end portion 164 may be located at spring mounting arm distal end portion 208.

Spa mounting assembly 104 may have any configuration that provides a rigid connection between lift assembly 100 and spa 10. Preferably, spa mounting assembly 104 allows for vertical and/or lateral (e.g. horizontal) position adjustment for lever arm rotation axis 140. The position of lever arm rotation axis 140 relative to spa 10 and cover 38 may be important to ensuring that sufficient clearance is provided for cover 38 to move between the spa cover closed and open positions, and to ensuring that cover 38 is positioned correctly in the spa cover closed and open positions.

Figure 5:
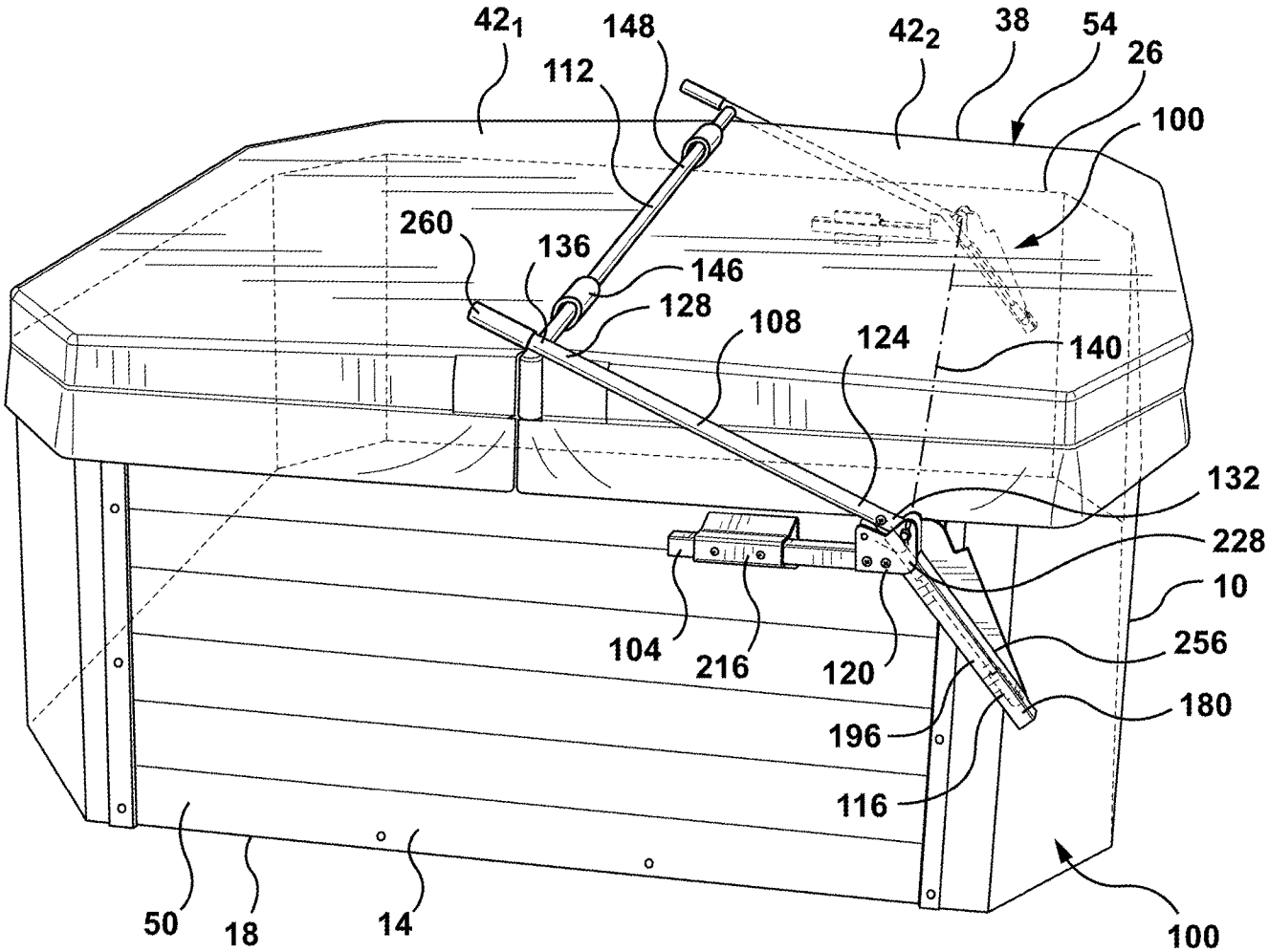
FIG. 5 is a perspective view of a spa equipped with a spa cover and two lift assemblies, in which the spa cover is in the spa cover closed position, in accordance with another embodiment.

FIG. 5 shows an example in which spa mounting assembly 104 includes a lateral positioning arm 212 and a spa sidewall mounting bracket 216. Lateral positioning arm 212 extends longitudinally from a lateral positioning arm proximal end portion 220 laterally outwardly to a lateral positioning arm distal end portion 224. Lateral positioning arm distal end portion 224 may be rigidly connected to spring mounting arm proximal end portion 204. Lateral positioning arm 212 may include lever arm mounting portion 120, or lever arm mounting portion 120 may be connected to lateral positioning arm 212. For example, lateral positioning arm distal end portion 224 may include or be connected to lever arm mounting portion 120. In the illustrated embodiment, lever arm mounting portion 120 includes a mounting member 228 (e.g. pair of mounting plates as shown) which is rigidly connected to lateral positioning arm distal end portion 224. The pivoting connection of lever arm proximal end portion 124 may be located at mounting member 228.

In use, the spa sidewall mounting bracket 216 may be rigidly connected to spa sidewall 14. Lateral positioning arm 212 may be laterally movable relative to the spa sidewall mounting bracket 216 between at least two lateral positions, and selectively rigidly connectable to the spa sidewall mounting bracket 216 at each lateral position (e.g. by set screw(s)). This allows the lateral positions of lever arm mounting portion 120, spring mounting portion 180, and lever arm 108 to be adjusted to accommodate the configuration of spa 10 and cover 38.

For example, in a modern spa with a flimsy sidewall construction, spa sidewall mounting bracket 216 may be rigidly connected at a location which aligns with one of the vertical studs behind spa sidewall 14. The location of the interior stud is unlikely to align with an appropriate location for lever arm rotation axis 140. Instead, lateral positioning arm 212 (along with or including lever arm mounting portion 120 and spring mounting portion 180) may be moved laterally (e.g. horizontally) relative to spa sidewall mounting bracket 216 to a desired lateral position, and then rigidly connected to the spa sidewall mounting bracket 216 at that position.

Reference is now made to FIGS. 1-4, which show a spa mounting assembly 104 in accordance with another embodiment. As shown, spa mounting assembly 104 includes a base portion 232 that may form a non-destructive rigid connection to spa 10. This may avoid drilling any holes into spa 10 (e.g. to accommodate fasteners) when mounting lift assembly 100. For example, base portion 232 may include a foot 236 (e.g. bearing plate) that extends rearwardly underneath spa bottom 18 and that relies upon the immense weight of spa 10 (particularly when filled with water) to provide an effective rigid connection to spa 10. In other words, the weight of spa 10 upon foot 236 may inhibit foot 236 (and spa mounting assembly 104) from moving while operating lift assembly 100 to move spa cover 38 between the spa cover closed and open positions.

As shown, lever arm mounting portion 120 and spring mounting portion 180 may be movable in one or more directions (e.g. laterally and/or vertically) relative to base portion 232 between at least two positions (e.g. lateral and/or vertical positions), and selectively rigidly connectable to base portion 232 at each position (e.g. using set screw(s)). This can provide the flexibility to position the moving elements of lift assembly 100 for compatibility with a wide range of spa configurations (shapes and sizes). For example, spa mounting assembly 104 may include the spa accessory mounting assembly of U.S. Provisional Patent Application No. 62/751,195, the entirety of which is hereby incorporated by reference.

In the illustrated example, spa mounting assembly 104 includes an upright support 240 and a lateral mount 244. Lateral mount 244 may be movable vertically relative to base portion 232 between at least two vertical positions, and rigidly connectable to base portion 232 at each location (e.g. using set screw(s)). For example, lateral mount 244 may be slideable vertically along upright support 240, and/or upright support 240 may be slideable vertically along base portion 232. As shown, base portion 232 may include an upstanding bracket 248 that joins upright support 240 to base portion 232. In this example, lateral positioning arm 212 may be laterally movable relative to lateral mount 244 between at least two lateral positions, and selectively rigidly connectable to lateral mount 244 at each position (e.g. using set screw(s)).

Still referring to FIGS. 1-4, depending the configuration of spa 10 and cover 38, lift assembly 100 may provide little or no interference with (i) users entering and exiting spa 10, and (ii) light and sightlines passing over spa upper end 26. As shown, lever arm rotation axis 140 extends in a rearward direction (e.g. perpendicular to gravity and the lateral direction). Lever arm rotation axis 140 may be located at an elevation below spa upper end 26. In addition, lever arm rotation axis 140 may intersect spa sidewall 14. Alternatively or in addition, when in the spa cover closed position, lever arm rotation axis 140 may be located at an elevation below spa cover 38. Alternatively or in addition, the entirety of spa mounting assembly 104 may be located at an elevation below spa upper end 26.

Lever arm 108 may rotate any angular distance between the spa cover closed and open positions. For example, lever arm 108 may rotate at least 90 degrees (e.g. 90 to 270 degrees). In the illustrated example, lever arm 108 is shown rotating approximately 135 degrees between the spa cover closed and open positions.

In some embodiments, lift assembly 100 may produce a pinch point between spa mounting assembly 104 and pneumatic spring 116, which may present a risk of user injury. As shown, when lever arm is in the cover open position (FIG. 3), an opening 252 may exist between rearward projections of (i) spa mounting assembly 104 (e.g. spring mounting arm 196), (ii) pneumatic spring 116, and (iii) lever arm 108. Opening 252 is closed as lift assembly 100 is moved to the spa cover closed position (FIG. 1). If a user (e.g. child) was to have a body party (e.g. finger) extending through opening 252 while lift assembly 100 was operated to closed spa cover 38, their body part could suffer serious injury (e.g. become broken). There may be many ways to mitigate this risk of injury.

In the illustrated example, spa mounting assembly 104 is shown including a guard 256. Guard 256 may be sized and positioned so that a rearward projection of guard 256 overlies opening 252. Accordingly, guard 256 may obstruct a user from unwisely inserting a body part through opening 252 while lift assembly 100 is being operated. As shown, guard 256 may be connected to spring mounting arm 196. For example, guard 256 may extend upwardly and laterally outwardly from spring mounting arm 196.

In other embodiments, spa mounting assembly 104 does not include a guard 256. For example, lateral positioning arm 212 may have a curved configuration that does not produce an opening which is closed when lift assembly 100 transitions between the spa cover open and closed positions.

Still referring to FIGS. 1-4, in some embodiments lift assembly 100 may include a handle 260 that a user can grasp to move lever arm 108 between the spa cover closed and open positions. As shown, handle 260 may be connected to lever arm distal end portion 128. For example, handle 260 may extend from lever arm distal end portion 128 away from lever arm rotation axis 140. This allows handle 260 to provide a user with a longer moment arm, whereby the user's mechanical advantage in rotating lever arm 108 is increased and therefore the force required by the user to rotate lever arm 108 is reduced. In the illustrated example, handle 260 extends away from lever arm distal end portion 128 parallel to lever arm 108 distal end portion 128. As compared with a handle that extends forwardly (i.e. away from spa 10), this design may inhibit handle 260 from interfering with, e.g. positioning spa front end 50 against a wall or fence. Still, in alternative embodiments, handle 260 may extend forwardly of lever arm distal end portion 128.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

Items:

Item 1: A lift assembly for assisting lifting a spa cover between a cover closed position, in which the spa cover closes an upper end of a spa, and a cover open position, the lift assembly comprising:

a spa mounting assembly that in use is rigidly connectable to a spa, the spa mounting assembly having a lever arm mounting portion connected to a spring mounting portion;

a lever arm extending longitudinally from a lever arm proximal end portion to a lever arm distal end portion, the lever arm proximal end portion having a pivoting connection to the lever arm mounting portion, the pivoting connection having a lever arm rotation axis, the lever arm rotation axis extending in a rearward direction, and the lever arm being rotatable relative to the spa mounting assembly about the lever arm rotation axis between (i) a cover closed position in which the lever arm distal end portion is laterally inwardly of the lever arm rotation axis, and (ii) a cover open position in which the lever arm distal end portion is laterally outwardly of the lever arm rotation axis;

a spa cover engaging member connected to the lever arm distal end portion; and a pneumatic spring comprising a pneumatic cylinder and a piston rod, the pneumatic spring extending longitudinally from a pneumatic spring proximal end portion to a pneumatic spring distal end portion, the pneumatic spring proximal end portion having a pivoting connection to the spring mounting portion at a location that is laterally outwardly of the lever arm rotation axis and that is at an elevation below the lever arm rotation axis, the pneumatic spring distal end portion having a pivoting connection to the lever arm at a location between the lever arm rotation axis and the lever arm distal end portion, and the pneumatic spring exerting an extensive force upon the lever arm both when the lever arm is in the cover closed position and when the lever arm is in the cover open position, the extensive force urging the lever arm towards the cover open position when the lever arm is in the cover closed position, and the extensive force urging the lever arm towards the cover closed position when the lever arm is in the cover open position.

Item 2: The lift assembly of any preceding item, wherein: the lever arm mounting portion is rigidly connected to the spring mounting portion.

Item 3: The lift assembly of any preceding item, wherein: the spring mounting portion comprises a spring mounting arm extending away from the lever arm mounting portion.

Item 4: The lift assembly of any preceding item, wherein: the extensive force is greater when the lever arm is in the cover open position than when the lever arm is in the cover closed position.

Item 5: The lift assembly of any preceding item, wherein: an opening is defined between rearward projections of (i) the spring mounting arm, (ii) the pneumatic spring, and (iii) the lever arm, when the lever arm is in the cover open position, the opening is closed when the lever arm is rotated to the cover closed position, and the spa mounting assembly further comprises a guard, a rearward projection of the guard overlying the opening.

Item 6: The lift assembly of any preceding item, wherein: the guard extends upwardly and laterally outwardly from the spring mounting arm.

Item 7: The lift assembly of any preceding item, wherein: an opening is defined between rearward projections of (i) the spa mounting assembly, (ii) the pneumatic spring, and (iii) the lever arm, when the lever arm is in the cover open position, the opening is closed when the lever arm is rotated to the cover closed position, and the spa mounting assembly further comprises a guard, a rearward projection of which overlies the opening.

Item 8: The lift assembly of any preceding item, wherein: the spa mounting assembly comprises a spa sidewall mounting bracket, the lever arm mounting portion and the spring mounting portion are laterally movable relative to the spa sidewall mounting bracket between at least two lateral positions, and the lever arm mounting portion and the spring mounting portion are selectively rigidly connectable to the spa sidewall mounting bracket at each of the lateral positions.

Item 9: The lift assembly of any preceding item, wherein: the spa mounting assembly comprises a base portion rigidly connectable to the spa, the lever arm mounting portion and the spring mounting portion are laterally movable relative to the base portion between at least two lateral positions, and the lever arm mounting portion and the spring mounting portion are selectively rigidly connectable to the base portion at each of the lateral positions.

Item 10: The lift assembly of any preceding item, further comprising:

a handle connected to the lever arm distal end portion, the handle extending from the lever arm distal end portion away from the lever arm rotation axis.

Item 11: The lift assembly of any preceding item, wherein: the spring mounting portion comprises a spring mounting arm, the spring mounting arm extending longitudinally from a spring mounting arm proximal end portion to a spring mounting arm distal end portion, the pivoting connection of the pneumatic spring proximal end portion is located at the spring mounting arm distal end portion, the spa mounting assembly comprising a lateral positioning arm extending longitudinally from a lateral positioning arm proximal end portion laterally outwardly to a lateral positioning arm distal end portion, the lateral positioning arm distal end portion rigidly connected to the spring mounting arm proximal end portion.

Item 12: The lift assembly of any preceding item, wherein: when the spa mounting assembly is rigidly connected to a spa, the lever arm rotation axis is located below an upper end of the spa.

Item 13: The lift assembly of any preceding item, wherein: when the spa mounting assembly is rigidly connected to a spa, the lever arm rotation axis intersects a sidewall of the spa.

Item 14: The lift assembly of any preceding item, wherein: when the spa mounting assembly is rigidly connected to a spa, the spa cover engaging member is engaged with a spa cover, and the lever arm is in the cover closed position: the lever arm rotation axis is located at an elevation below the spa cover.

Item 15: The lift assembly of any preceding item, wherein: when the spa mounting assembly is rigidly connected to a spa, the spa mounting assembly is located at an elevation below an upper end of the spa.

Item 16: The lift assembly of any preceding item, wherein: the spa cover engaging portion comprises a spa cover supporting arm, the spa cover supporting arm extending rearwardly from the lever arm distal end portion.

Item 17: A lift assembly for assisting lifting a spa cover between a cover closed position and a cover open position, the lift assembly comprising:

a lever arm mounting portion connected to a spring mounting portion;

a lever arm extending from a lever arm proximal end portion to a lever arm distal end portion, the lever arm proximal end portion having a pivoting connection to the lever arm mounting portion, the pivoting connection having a lever arm rotation axis, and the lever arm being rotatable relative to the lever arm mounting portion and the spring mounting portion about the lever arm rotation axis between (i) a cover closed position, and (ii) a cover open position;

a spa cover engaging member connected to the lever arm distal end portion; and a pneumatic spring comprising a pneumatic cylinder and a piston rod, the pneumatic spring extending from a pneumatic spring proximal end portion to a pneumatic spring distal end portion, the pneumatic spring proximal end portion having a pivoting connection to the spring mounting portion, the pneumatic spring distal end portion having a pivoting connection to the lever arm, and the pneumatic spring exerting an extensive force upon the lever arm both when the lever arm is in the cover closed position and when the lever arm is in the cover open position, the extensive force urging the lever arm towards the cover open position when the lever arm is in the cover closed position, and the extensive force urging the lever arm towards the cover closed position when the lever arm is in the cover open position.

Item 18: The lift assembly of any preceding item, wherein: the lever arm mounting portion is rigidly connected to the spring mounting portion.

Item 19: The lift assembly of any preceding item, wherein: the extensive force is greater when the lever arm is in the cover open position than when the lever arm is in the cover closed position.

Item 20: The lift assembly of any preceding item, further comprising:

a handle connected to the lever arm distal end portion, the handle extending from the lever arm distal end portion away from the lever arm rotation axis.

The invention claimed is:

1. A lift assembly for assisting lifting a spa cover between a cover closed position, in which the spa cover closes an upper end of a spa, and a cover open position, the lift assembly comprising:

a spa mounting assembly that in use is rigidly connectable to a spa, the spa mounting assembly having a lever arm mounting portion connected to a spring mounting portion;

a lever arm extending longitudinally from a lever arm proximal end portion to a lever arm distal end portion, the lever arm proximal end portion having a pivoting connection to the lever arm mounting portion, the pivoting connection having a lever arm rotation axis, the lever arm rotation axis extending in a rearward direction, and the lever arm being rotatable relative to the spa mounting assembly about the lever arm rotation axis between (i) a cover closed position in which the lever arm distal end portion is laterally inwardly of the lever arm rotation axis, and (ii) a cover open position in which the lever arm distal end portion is laterally outwardly of the lever arm rotation axis;

a spa cover engaging member connected to the lever arm distal end portion; and a pneumatic spring comprising a pneumatic cylinder and a piston rod, the pneumatic spring extending longitudinally from a pneumatic spring proximal end portion to a pneumatic spring distal end portion, the pneumatic spring proximal end portion having a pivoting connection to the spring mounting portion at a location that is laterally outwardly of the lever arm rotation axis and that is at an elevation below the lever arm rotation axis, the pneumatic spring distal end portion having a pivoting connection to the lever arm at a location between the lever arm rotation axis and the lever arm distal end portion, and the pneumatic spring exerting an extensive force upon the lever arm both when the lever arm is in the cover closed position and when the lever arm is in the cover open position, the extensive force urging the lever arm towards the cover open position when the lever arm is in the cover closed position, and the extensive force urging the lever arm towards the cover closed position when the lever arm is in the cover open position.

2. The lift assembly of claim 1, wherein:

the lever arm mounting portion is rigidly connected to the spring mounting portion.

3. The lift assembly of claim 1 wherein:

the spring mounting portion comprises a spring mounting arm extending away from the lever arm mounting portion.

4. The lift assembly of claim 1 wherein:

the extensive force is greater when the lever arm is in the cover open position than when the lever arm is in the cover closed position.

5. The lift assembly of claim 3, wherein:

an opening is defined between rearward projections of (i) the spring mounting arm, (ii) the pneumatic spring, and (iii) the lever arm, when the lever arm is in the cover open position, the opening is closed when the lever arm is rotated to the cover closed position, and the spa mounting assembly further comprises a guard, a rearward projection of the guard overlying the opening.

6. The lift assembly of claim 5, wherein:

the guard extends upwardly and laterally outwardly from the spring mounting arm.

7. The lift assembly of claim 1 wherein:

an opening is defined between rearward projections of (i) the spa mounting assembly, (ii) the pneumatic spring, and (iii) the lever arm, when the lever arm is in the cover open position, the opening is closed when the lever arm is rotated to the cover closed position, and the spa mounting assembly further comprises a guard, a rearward projection of which overlies the opening.

8. The lift assembly of claim 1 wherein:

the spa mounting assembly comprises a spa sidewall mounting bracket, the lever arm mounting portion and the spring mounting portion are laterally movable relative to the spa sidewall mounting bracket between at least two lateral positions, and the lever arm mounting portion and the spring mounting portion are selectively rigidly connectable to the spa sidewall mounting bracket at each of the lateral positions.

9. The lift assembly of claim 1 wherein:

the spa mounting assembly comprises a base portion rigidly connectable to the spa, the lever arm mounting portion and the spring mounting portion are laterally movable relative to the base portion between at least two lateral positions, and the lever arm mounting portion and the spring mounting portion are selectively rigidly connectable to the base portion at each of the lateral positions.

10. The lift assembly of claim 1 further comprising:

a handle connected to the lever arm distal end portion, the handle extending from the lever arm distal end portion away from the lever arm rotation axis.

11. The lift assembly of claim 1, wherein:

the spring mounting portion comprises a spring mounting arm, the spring mounting arm extending longitudinally from a spring mounting arm proximal end portion to a spring mounting arm distal end portion, the pivoting connection of the pneumatic spring proximal end portion is located at the spring mounting arm distal end portion, the spa mounting assembly comprising a lateral positioning arm extending longitudinally from a lateral positioning arm proximal end portion laterally outwardly to a lateral positioning arm distal end portion, the lateral positioning arm distal end portion rigidly connected to the spring mounting arm proximal end portion.

12. The lift assembly of claim 1 wherein:

when the spa mounting assembly is rigidly connected to a spa, the lever arm rotation axis is located below an upper end of the spa.

13. The lift assembly of claim 1 wherein:

when the spa mounting assembly is rigidly connected to a spa, the lever arm rotation axis intersects a sidewall of the spa.

14. The lift assembly of claim 1 wherein:

when the spa mounting assembly is rigidly connected to a spa, the spa cover engaging member is engaged with a spa cover, and the lever arm is in the cover closed position: the lever arm rotation axis is located at an elevation below the spa cover.

15. The lift assembly of claim 1 wherein:

when the spa mounting assembly is rigidly connected to a spa, the spa mounting assembly is located at an elevation below an upper end of the spa.

16. The lift assembly of claim 1 wherein:

the spa cover engaging portion comprises a spa cover supporting arm, the spa cover supporting arm extending rearwardly from the lever arm distal end portion.

* * * * *